US009085917B2

(12) United States Patent
Kriete et al.

(10) Patent No.: US 9,085,917 B2
(45) Date of Patent: Jul. 21, 2015

(54) INTERCHANGEABLE CYLINDER SYSTEM

(71) Applicants: Horst Kriete, Minden (DE); Sonke Schluter, Karisruhe (DE)

(72) Inventors: Horst Kriete, Minden (DE); Sonke Schluter, Karisruhe (DE)

(73) Assignee: MARTIN LEHMANN GMBH & CO. KG, Minden (DE)

( * ) Notice: Subject to any disclaimer, the term of this patent is extended or adjusted under 35 U.S.C. 154(b) by 0 days.

(21) Appl. No.: 13/755,645

(22) Filed: Jan. 31, 2013

(65) Prior Publication Data

US 2013/0199253 A1 Aug. 8, 2013

(30) Foreign Application Priority Data

Feb. 3, 2012 (DE) ..... 20 2012 100 370 U

(51) Int. Cl.
*E05B 27/00* (2006.01)
*E05B 9/08* (2006.01)

(52) U.S. Cl.
CPC ..... *E05B 9/084* (2013.01)

(58) Field of Classification Search
USPC ..... 70/367, 368, 370, 371
See application file for complete search history.

(56) References Cited

U.S. PATENT DOCUMENTS

| | | | | | |
|---|---|---|---|---|---|
| 1,913,963 | A * | 6/1933 | Shinn | 70/368 |
| 3,526,111 | A * | 9/1970 | Jacobi | 70/368 |
| 4,404,825 | A * | 9/1983 | Dixon et al. | 70/368 |
| 4,712,402 | A * | 12/1987 | Monahan | 70/383 |
| 5,285,667 | A * | 2/1994 | Fukasawa et al. | 70/379 R |
| 5,634,359 | A | 6/1997 | Huebschen | |
| 5,640,864 | A * | 6/1997 | Miyamoto | 70/379 R |
| 5,775,147 | A * | 7/1998 | Wittwer | 70/379 R |
| 5,911,766 | A * | 6/1999 | Lieb et al. | 70/422 |
| 5,979,200 | A * | 11/1999 | Cliff | 70/491 |
| 6,112,565 | A | 9/2000 | Aramburu | |
| 7,234,331 | B2 * | 6/2007 | Armstrong et al. | 70/492 |
| 7,650,769 | B2 * | 1/2010 | Lo | 70/368 |
| 8,291,735 | B1 * | 10/2012 | Damikolas | 70/383 |
| 8,336,349 | B2 * | 12/2012 | Thimmappa et al. | 70/371 |

FOREIGN PATENT DOCUMENTS

| | | |
|---|---|---|
| DE | 40 08 649 | 9/1991 |
| DE | 10 2009 044 116 | 4/2010 |
| EP | 1 256 669 | 11/2002 |

OTHER PUBLICATIONS

German Search Report for Application No. 20 2012 100 370.8, dated Dec. 12, 2012.

* cited by examiner

*Primary Examiner* — Suzanne Barrett
(74) *Attorney, Agent, or Firm* — Thomas, Karceski & Karmilovich, PC

(57) ABSTRACT

An interchangeable cylinder system for furniture locks. The interchangeable cylinder system includes a cylinder housing, a lock cylinder configured to be inserted into and withdrawn from the cylinder housing. The lock cylinder is configured to be twisted about a longitudinal axis of the lock cylinder between an opening position and a closing position. The lock cylinder includes a collar which protrudes radially with respect to the longitudinal axis and beyond a jacket surface of the lock cylinder. The lock cylinder includes an opening into which an unlocking element is configured to be inserted. The jacket surface includes an annular groove into which a locking element engages to secure the lock cylinder in the cylinder housing. An axial stop is integrally attached in an interior of the cylinder housing and through which stop a base region of the locking cylinder extends, which base region is remote from the collar.

7 Claims, 3 Drawing Sheets

INTERCHANGEABLE CYLINDER SYSTEM

CROSS-REFERENCE TO RELATED APPLICATION

This application is claims benefit of and priority to German Patent Application No. 20 2012 100 370.8, filed Feb. 3, 2012, the content of which Application is incorporated by reference herein.

BACKGROUND AND SUMMARY

The present disclosure relates to an interchangeable cylinder system for furniture locks The interchangeable cylinder system includes a cylinder housing, a lock cylinder configured to be inserted into and withdrawn from the cylinder housing from a face side of the cylinder housing, and the lock cylinder is further configured to be twisted about a longitudinal axis of the lock cylinder and the cylinder housing between an opening position and a closing position in the cylinder housing. The lock cylinder includes a collar which protrudes radially with respect to the longitudinal axis and beyond a jacket surface of the lock cylinder. The lock cylinder further includes an opening into which an unlocking element is configured to be inserted. The jacket surface includes an annular groove into which a locking element engages to secure the lock cylinder in the cylinder housing. An axial stop is integrally attached in an interior of the cylinder housing and through which stop a base region of the locking cylinder extends, which base region is remote from the collar.

A generic interchangeable cylinder system is known, for example, from DE 36 03 655 A1. Such interchangeable cylinder systems substantially consist of a cylinder housing and a lock cylinder which can be inserted into the cylinder housing and is exchangeably held in the cylinder housing and is rotationally adjustable between an opening and a closing position by a key that fits into the lock cylinder. The axial fixing of the lock cylinder in the cylinder housing occurs in such case by a leaf spring which is placed into a channel provided axially in the jacket surface of the cylinder housing and protrudes with one end into an annular groove in the jacket surface of the lock cylinder and thereby prevents the lock cylinder from being pulled out of the cylinder housing. For the purpose of removing the lock cylinder from the cylinder housing, an opening is provided on a collar of the lock cylinder which impinges on a face side of the cylinder housing and through which a wire pin is inserted into the channel between the lock cylinder and the cylinder housing which presses the leaf spring out of the groove by inserting the wire pin into the channel. This can only be achieved with much difficulty as a result of the freedom of movement of the leaf spring in the channel between the lock cylinder and the cylinder housing.

It is further disadvantageous that, in principle, any wire pin which can be inserted into the opening in the face side of the lock cylinder is able to press the leaf spring out of the groove in the lock cylinder in order to enable the removal of the lock cylinder from the cylinder housing.

Embodiments of the present disclosure, however, provide for an interchangeable cylinder system for furniture locks in such a way that unlocking of the lock cylinder from the cylinder housing can be performed in a simpler and operationally more reliable manner and the holding function of the locking is improved further.

The embodiments of the present disclosure thus provide for an interchangeable cylinder system that includes a cylinder housing, a lock cylinder configured to be inserted into and withdrawn from the cylinder housing from a face side of the cylinder housing, and the lock cylinder is further configured to be twisted about a longitudinal axis of the lock cylinder and the cylinder housing between an opening position and a closing position in the cylinder housing. The lock cylinder includes a collar which protrudes radially with respect to the longitudinal axis and beyond a jacket surface of the lock cylinder. The lock cylinder further includes an opening into which an unlocking element is configured to be inserted. The jacket surface includes an annular groove into which a locking element engages to secure the lock cylinder in the cylinder housing. An axial stop is integrally attached in an interior of the cylinder housing and through which stop a base region of the locking cylinder extends, which base region is remote from the collar. The locking element encloses a jacket of the lock cylinder and rests in a recess provided on a side of the axial stop which faces away from the collar. The locking element is held in a spring-loaded manner in a locked position and engages in the annular groove. The locking element is displaceable by an unlocking element against a force of a spring out of the annular groove into a release position in which the lock cylinder is removable from the cylinder housing.

Thus, accordance with the present disclosure, the locking element that locks the lock cylinder in the cylinder housing is arranged as a platelet enclosing the jacket of the lock cylinder. The platelet rests in a recess of the collar on the opposite side of an axial stop of the cylinder housing. The locking element is held in a spring-loaded manner in a locked position engaging into an annular groove in the jacket surface of the lock cylinder and is displaceable by the unlocking element against the spring load out of the annular groove into a release position in which the lock cylinder can be removed from the cylinder housing.

Such a locking element arranged as a platelet is easy to produce, can be mounted easily on the lock cylinder and, due to the fact that it rests in a completely encapsulated manner in the cylinder housing, it offers considerably higher security than a leaf spring engaging from the outside into the groove of the cylinder core, as is the case in the aforementioned state of the art.

Embodiments according to the present disclosure are discussed herein and in the appended claims.

In accordance with an embodiment of the present disclosure, the locking element includes a press-in bevel on which an associated end, that is, the tip of the unlocking element rests and displaces the locking element radially against the spring force out of the annular groove during its forward displacement for unlocking the locking element and thereby releasing the lock.

As a result, the interchangeable cylinder system is additionally protected against manipulations because the unlocking element needs to have a cross section of defined width in order to displace the locking element to a sufficiently far extent and to release the same from the engagement with the groove in the lock cylinder.

In accordance with a further embodiment according to the present disclosure, the locking element includes, for example, a sickle-shaped locking collar on its inner edge on the side radially opposite of the press-in bevel. The locking collar rests in the annular groove in the locking position of the locking element. This also contributes to the protection from an unauthorized removal of the lock cylinder because the locking collar that locks the lock cylinder cannot be reached by the unlocking element.

The outside contour of the locking element is provided with a square configuration in accordance with an embodiment of the present disclosure. The locking element is held in a spring-loaded manner in a corner on the cylinder housing, and the corners of the square locking element which are adjacent to the above-noted corner are provided with a flattened configuration as a sliding guide. The inner contour of the recess of the axial stop is formed according to the outside contour of the locking element, with the width of the inner contour of the recess corresponding to the width of the locking element plus the maximum width of the locking collar. This provides a sliding surface in the recess of the axial stop for the locking element, which permits a guided displacement of the locking element which occurs perpendicularly to the longitudinal axis of the locking cylinder. This is so that the axial play of the lock cylinder in the cylinder housing required for unlocking the lock cylinder is reduced considerably in accordance with embodiments of the present disclosure, as compared to solutions known from the state of the art.

Other aspects of the present disclosure will become apparent from the following descriptions when considered in conjunction with the accompanying drawings.

DETAILED DESCRIPTION

Figure 1:
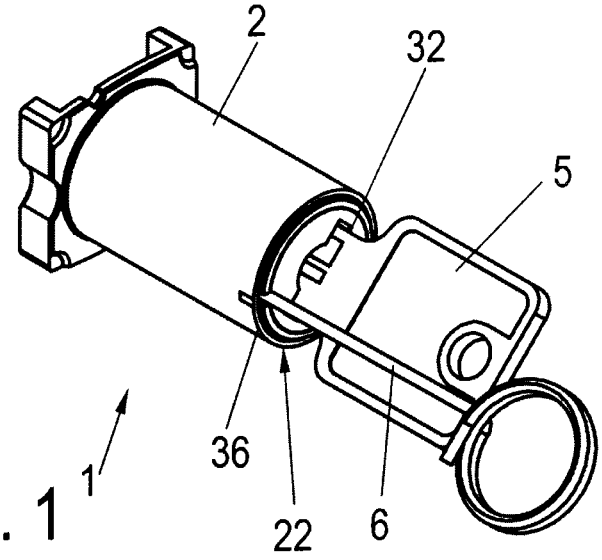
FIG. 1 shows a perspective view of an embodiment of an interchangeable cylinder system, in accordance with the present disclosure.
Figure 2:
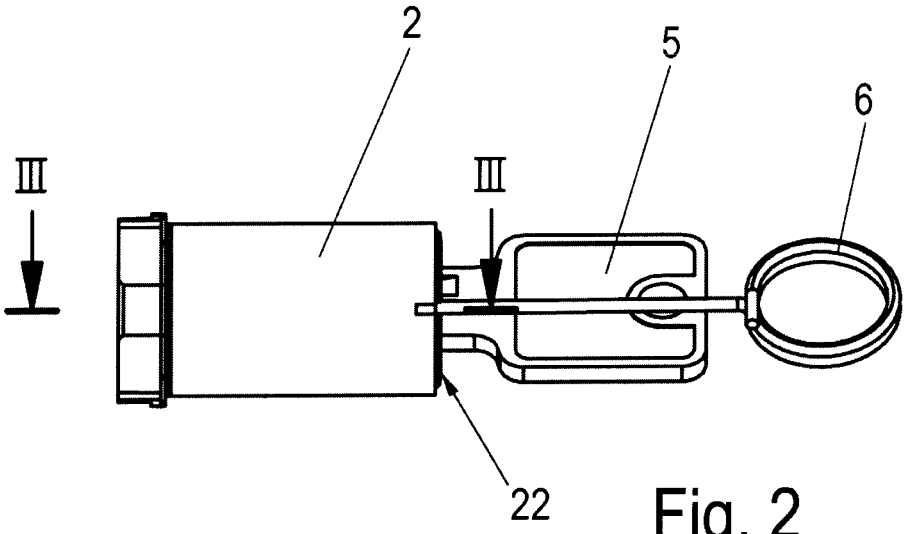
FIG. 2 shows a side view of the interchangeable cylinder system of FIG. 1.

In the description herein, the terms such as above, below, left, right, front, and, for example, rear relate to the illustrations shown and positions of the cylinder, cylinder housing, locking element and other elements of the present disclosure as shown in the drawings. These terms shall not be understood as being limiting in any way, meaning that such references can change by different working positions or mirror-symmetrical configurations, for example.

FIG. 1 shows an embodiment of an interchangeable cylinder system 1, in accordance with the present disclosure. The interchangeable cylinder system 1 comprises a cylinder housing 2, in which a lock cylinder 3, which can be inserted into and withdrawn from the cylinder housing 2, is inserted from a face side 22. The lock cylinder can be twisted between an opening position and a closing position in the cylinder housing 2 about a longitudinal axis L of the lock cylinder 3.

Figure 3:
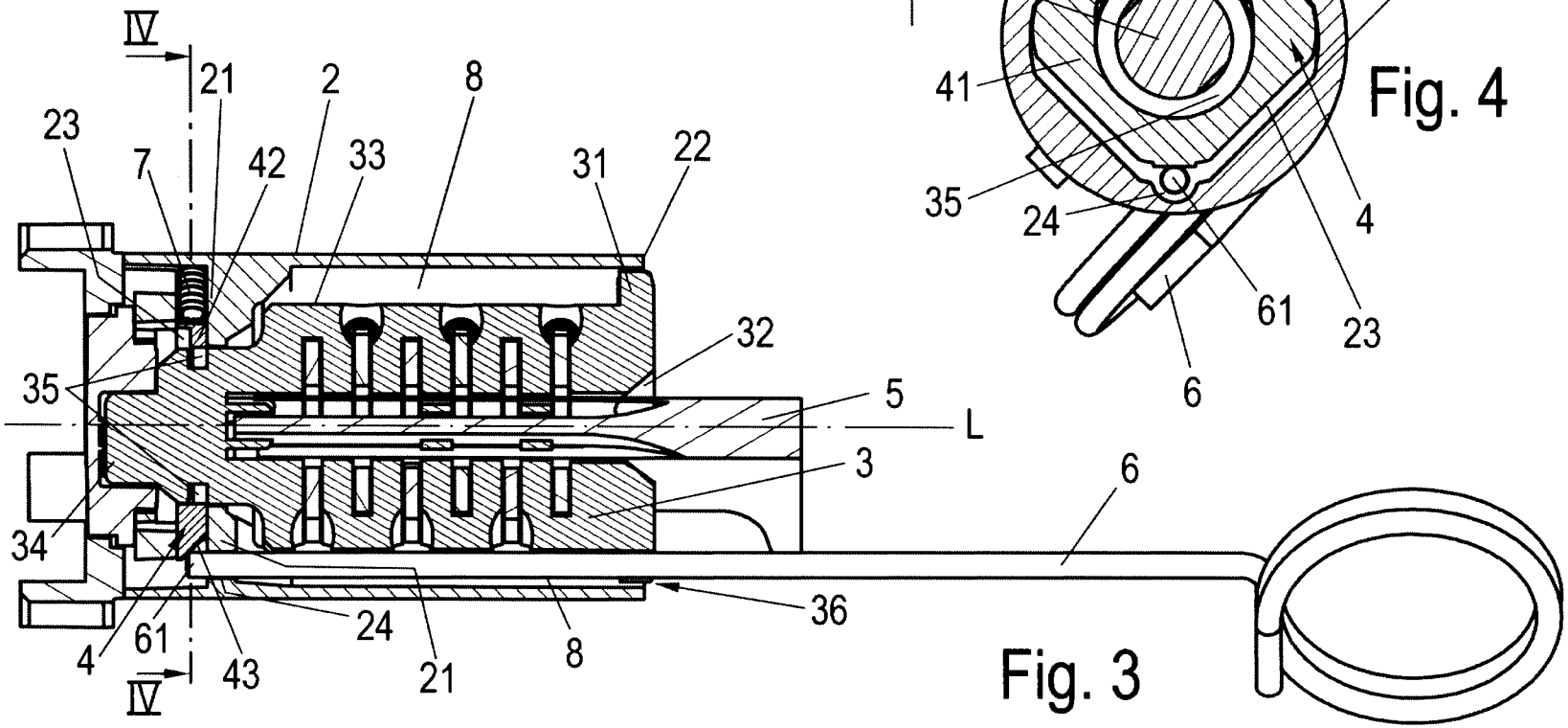
FIG. 3 shows a sectional view of the interchangeable cylinder system of FIG. 2 in the unlocked position along a line of intersection designated with reference numerals III in FIG. 2.
Figure 5:
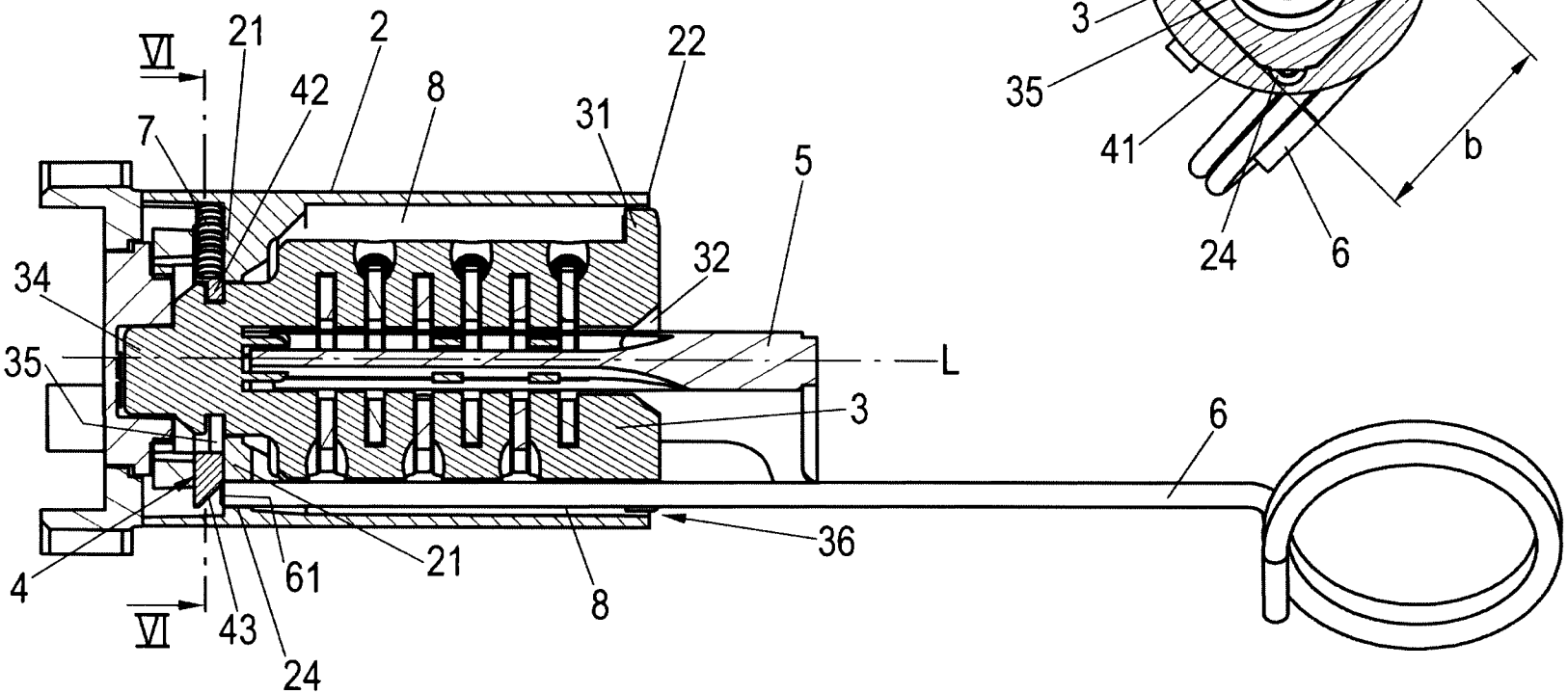
FIG. 5 shows a sectional view of the interchangeable cylinder system according to FIG. 3, but in the locked position.

The lock cylinder 3 includes a circumferential collar 31 (see FIG. 3) on the face side 22 which protrudes beyond a jacket surface 33 of the lock cylinder 3 radially to the longitudinal axis L of the lock cylinder 3, as shown in FIGS. 3 and 5. A key channel 32, in which a key 5 is inserted, extends centrally and axially in the lock cylinder 3, starting from the face surface or side 22, which is laterally limited by the collar 31, with the key actuating the lock cylinder 3 in an opening and a closing position in the cylinder housing 2.

Furthermore, a through-opening 36, which converges into a channel 8, is provided in the collar 31 on a radially outer position, through which through-opening 36 a rod-like unlocking element 6 can be guided. The unlocking element 6 is used to unlock the lock cylinder 3 from a locking condition with the cylinder housing 2 provided in the base region 34 of the lock cylinder 3 in order to enable the removal of the lock cylinder 3 from the cylinder housing 2. The contour of the shaft of the unlocking element 6 can be chosen, and, in accordance with the present disclosure, the unlocking element 6 can be round, that is, for example, circular or oval, and, alternatively, can also be polygonal. For this purpose, the through-opening 36 is adjustable in its cross-section, so that flexible encoding is obtained.

In order to secure the lock cylinder 3 in the cylinder housing 2 against removal, an annular groove 35 is provided in the jacket surface 33 of the lock cylinder 3, as shown in FIGS. 3 to 6, into which annular groove 35 a locking element 4 with a locking collar 42 engages for securing the lock cylinder 3 in the cylinder housing 2.

The locking element 4, which is arranged as a platelet enclosing the jacket 33 of the lock cylinder 3, rests in a recess 23 provided in a side of the axial stop 21 facing away from the collar 31. The axial stop 21 is integrally attached in the interior of the cylinder housing 2 and includes an opening through which a base region 34 of the lock cylinder 3 extends, which base region 34 is remote from the collar 31.

For the purpose of holding the locking element 4 in a predetermined locking position in the recess 23 of the axial stop 21, the locking element 4 is fastened by a compression spring 7 on the cylinder housing 2.

Figure 4:
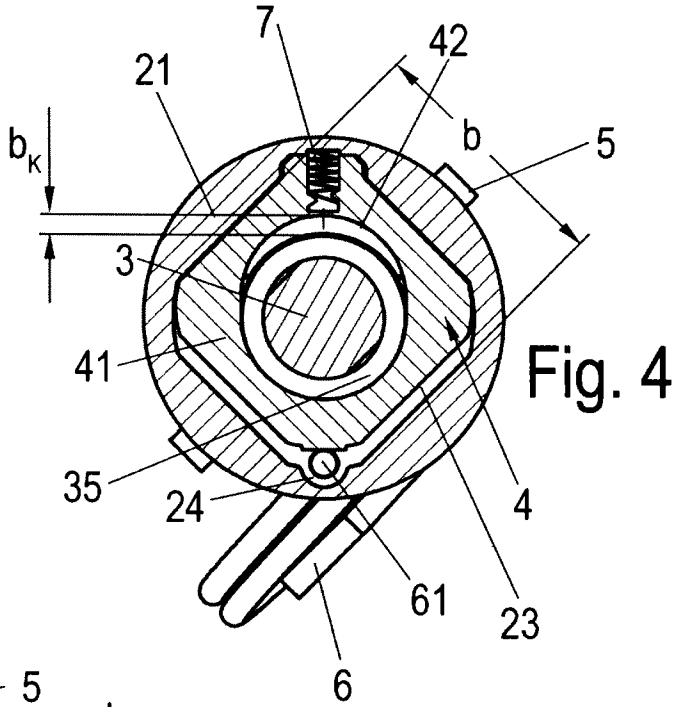
FIG. 4 shows a sectional view of the interchangeable cylinder system of FIG. 3 along a line of intersection designated with reference numerals IV in FIG. 3.
Figure 6:
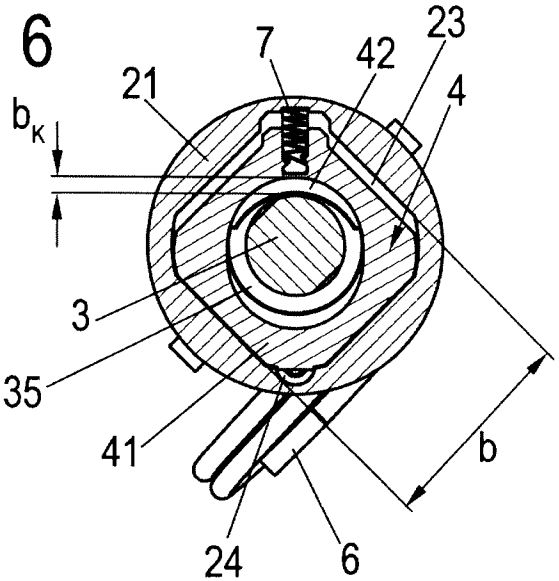
FIG. 6 shows a cross-sectional view through the interchangeable cylinder system along the line of intersection designated with reference numerals VI-VI in FIG. 5.

As is shown in FIGS. 4 and 6, the locking element 4 is arranged as a substantially square platelet with flattened corners. One of the corners of the locking element 4, which in the locking position (see FIG. 5 and FIG. 6) covers a borehole 24 in the axial stop 21, is arranged as a press-in bevel 43 which rises towards the outside edge and on which a tip 61 of the inserted unlocking element 6 is supported. When the unlocking element 6 is inserted further, the locking element 4 is displaced radially in the direction of the compression spring 7, with the locking collar 42 being guided out of the annular groove 35 and with the lock being released.

The locking collar 42, which engages into the annular groove 35 in the locking position as shown in FIGS. 5 and 6, is arranged in the manner of a sickle and is integrally attached to the locking element 4 on its inner edge on the side thereof opposite of the press-in bevel 43.

Embodiments of the present disclosure are configured in such a way that in the locking position of the locking element 4, the locking collar 42 which locks the lock cylinder 3 onto the cylinder housing 2 cannot be reached from the outside by the unlocking element 6 which passes through the channel 8 between the cylinder housing 2 and the jacket surface 33 of the lock cylinder 3.

In order to provide a further obstruction for any an unauthorized unlocking of the lock cylinder 3 from the cylinder housing 2, the cross-sectional width of the unlocking element 6 corresponds to the path of displacement required for displacing locking element 4 from the engagement with the annular groove 35. That is, if a locking element 4 of insufficient cross-section is introduced into the channel 8, the locking element 4 which is arranged as a platelet can only be displaced partly in the direction of the compression spring 7 against the pressure of the compression spring 7.

An only partial displacement of the locking element 4 will not lead to the consequence that the locking collar 42 of the locking element 4 will be pushed out completely from the annular groove 35, so that the locking element 4 will continue to lock the locking cylinder 3 onto the cylinder housing 2.

In order to control the path of displacement of the locking element 4 in an operationally reliable manner, the corners adjacent to the corner of the locking element 4 on which the compression spring 7 is fixed is arranged in a flattened manner as a sliding guide. Accordingly, the inner contour of the recess 23 of the axial stop 21 is shaped according to the outer contour of the locking element 4, with the width b of the inner contour of the recess 23 corresponding to the width of the locking element 4 plus the maximum width IN of the locking collar 42 of the locking element 4.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. An interchangeable cylinder system for furniture locks, the interchangeable cylinder system comprising:

a cylinder housing;

a lock cylinder configured to be inserted into and withdrawn from the cylinder housing from a face side of the cylinder housing, the lock cylinder further configured to be twisted about a longitudinal axis of the lock cylinder and the cylinder housing between an opening position and a closing position in the cylinder housing;

the lock cylinder includes a collar which protrudes radially with respect to the longitudinal axis and beyond a jacket surface of the lock cylinder, the lock cylinder further includes an opening into which an unlocking element is configured to be inserted;

the jacket surface includes an annular groove into which a locking element engages to secure the lock cylinder in the cylinder housing;

an axial stop is integrally attached in an interior of the cylinder housing and through which stop a base region of the locking cylinder extends, which base region is remote from the collar;

the locking element encloses a jacket of the lock cylinder and rests in a recess provided on a side of the axial stop which faces away from the collar;

the locking element is held in a spring-loaded manner in a locked position and engages in the annular groove, the locking element being displaceable by the unlocking element against a force of a spring out of the annular groove into a release position in which the lock cylinder is removable from the cylinder housing;

wherein the locking element includes an inner edge having a locking collar on a side opposite of the press-in bevel, which locking collar rests in the annular groove in the locked position of the locking element; and wherein an outer contour of the locking element is arranged in a square manner, with the locking element being fixed at a first corner to the cylinder housing in a spring-loaded manner and corners adjacent to the first corner being arranged in a flattened manner as a sliding guide, and an inner contour of the recess of the axial stop is shaped according to an outer contour of the locking element, with a width of the inner contour of the recess corresponding to a width of the locking element plus a maximum width of the locking collar of the locking element.

2. The interchangeable cylinder system according to claim 1, further comprising a press-in bevel integrally attached to the locking element, which press-in bevel is configured to be touched by the unlocking element during a release process, and a forward displacement of the unlocking element against the press-in bevel produces a displacement of the locking element out of engagement with the annular groove.

3. The interchangeable cylinder system claim 1, wherein a cross-sectional width of the unlocking element corresponds to a path of displacement for displacing the locking element out of the engagement with the annular groove.

4. The interchangeable cylinder system claim 1, wherein the locking element is fixed by a compression spring to the cylinder housing.

5. The interchangeable cylinder system claim 1, wherein a shaft of the unlocking element has one of a round and polygonal cross-sectional contour, to which a cross-sectional contour of an opening is adjusted.

6. The interchangeable cylinder system according to claim 1, wherein the locking collar is shaped as a sickle.

7. The interchangeable cylinder system according to claim 1, wherein the locking element is configured as a platelet.

* * * * *